United States Patent [19]

Bertagni

[11] 4,184,563

[45] Jan. 22, 1980

[54] PLANAR DIAPHRAGM AND SUPPORTING FRAME ASSEMBLY

[76] Inventor: José J. Bertagni, 1001 Uriburu, 1643 Beccar, Argentina

[21] Appl. No.: 971,734

[22] Filed: Dec. 21, 1978

[51] Int. Cl.[2] ..... G10K 13/00; H04R 7/00

[52] U.S. Cl. ..... 181/171; 181/174

[58] Field of Search ..... 181/171, 172, 173, 174, 181/167, 157; 179/115.5 R, 181 R, 181 F

[56] References Cited

U.S. PATENT DOCUMENTS

| | | | |
|---|---|---|---|
| 3,596,733 | 8/1971 | Bertagni | 181/157 |
| 3,767,005 | 10/1973 | Bertagni | 181/174 |
| 4,003,449 | 1/1977 | Bertagni | 181/173 |

*Primary Examiner*—Stephen J. Tomsky
*Attorney, Agent, or Firm*—Fleit & Jacobson

[57] ABSTRACT

A substantially planar diaphragm and supporting frame assembly, preferably for loudspeakers, where on the rear face side of said diaphragm there is an asymmetrically shaped sound producing portion defining the central portion of said diaphragm, which central portion is surrounded by a marginal portion including spaced-apart teeth-like projections which define the periphery of said marginal portion and an endless channel in said marginal portion between said teeth-like projections and said central portion, a resilient cushion-like damping washer having two opposite faces one of which is linked to said teeth-like projections and the other face being linked to said supporting frame, and said washer having blind cuts on said other face, at least in those portions which are located in-between said spaced-apart teeth-like projections.

6 Claims, 6 Drawing Figures

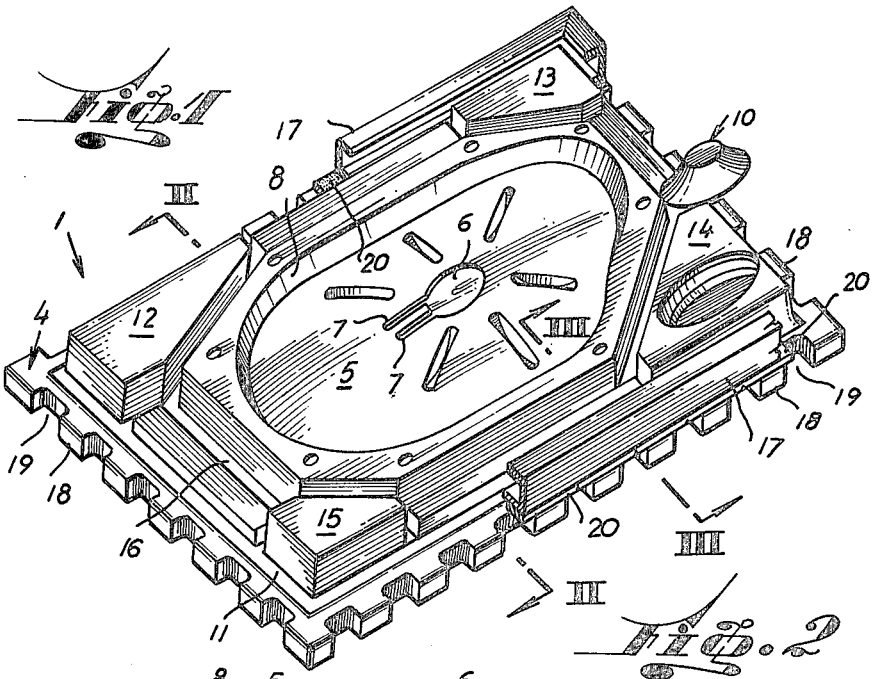
Fig. 1
Fig. 2
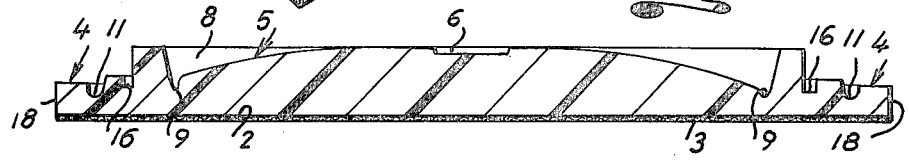
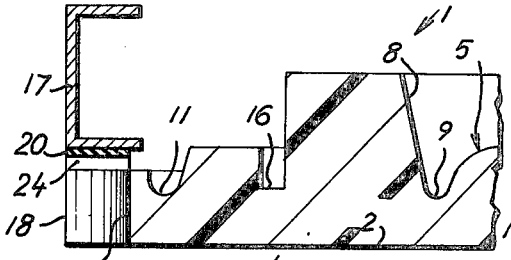
Fig. 3
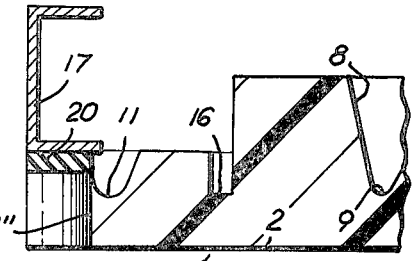
Fig. 5
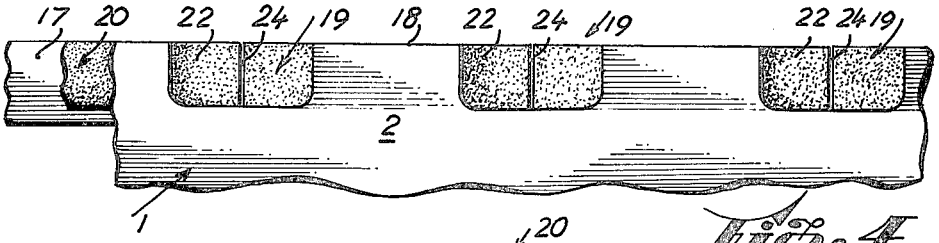
Fig. 4
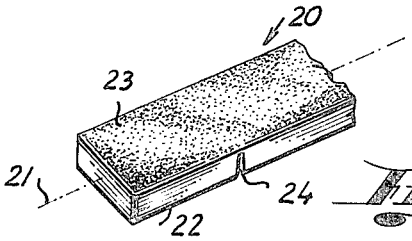
Fig. 6

PLANAR DIAPHRAGM AND SUPPORTING FRAME ASSEMBLY

BACKGROUND OF THE INVENTION

This invention relates to a substantially planar diaphragm and supporting frame assembly for use in an electroacoustic transducer and more particularly the diaphragm uses, in principle, the teaching of my U.S. Pat. No. 4,003,449. The diaphragm disclosed in said specification has been further developed in an effort to improve the quality of the sound when such diaphragm is used in a so called "flat loudspeaker". Tests have shown that the marginal portion of the diaphragm should be so supported on a frame that the active portion of the diaphragm may almost be considered as being floatingly supported, whereby the sound qualities become improved.

SUMMARY OF THE INVENTION

The invention relates, in general terms, to a planar diaphragm and supporting frame assembly, preferably for loudspeakers, where on the rear face side of said diaphragm there is an asymmetrically shaped sound producing portion defining the central portion of said diaphragm, which central portion is surrounded by a marginal portion including spaced-apart teeth-like projections which define the periphery of said marginal portion and an endless channel in said marginal portion between said teeth-like projections and said central portion, a resilient cushion-like damping washer having two opposite faces one of which is linked to said teeth-like projections and the other face being linked to said supporting frame.

BRIEF DESCRIPTION OF THE DRAWINGS

To facilitate the explanation of the different features of the invention reference will now be made to the accompanying drawings, wherein:

FIG. 1 is a perspective view, partially in section, of the diaphragm and supporting frame assembly seen from its rear face.

FIG. 2 is a cross section along line II—II of FIG. 1.

FIG. 3 is a cross section along line III—III of FIG. 1.

FIG. 4 is a detail in plan view showing the arrangement of the teeth-like projections, damping washer and frame.

FIG. 5 is a cross section similar to FIG. 3 of a slightly modified embodiment.

FIG. 6 is a detail, in perspective view, of a portion of the resilient, cushion-like damping washer.

DESCRIPTION OF THE PREFERRED EMBODIMENTS

The planar diaphragm 1 is a plate-like member made of cellular plastics material and has a flat front face 2 which may be sheathed (as only shown in FIG. 2) with a fabric 3. The rear face defines through its central portion, an asymmetrically shaped portion 5 having preferably a central recess 6 which is out of the geometrical center of said asymmetrically shaped portion 5 and to which a voice coil, forming part of an electromagnetic assembly (not shown) is to be connected, as already explained in my U.S. Pat. No. 3,801,943. Conveniently the central recess 6 is connected to a pair of channels 7 to house therein the outcoming conductors (not shown) of the above referred to electromagnetic assembly. A marginal portion 4 circumscribes said central portion including said asymmetrically shaped portion 5.

The asymmetrically shaped portion 5 represents the active portion of the diaphragm, at least for the low frequency and medium frequency ranges. The aim in a planar diaphragm of the type here described is that the vibrations generated at the central recess 6 do not move beyond the side wall 8. In practice this is an almost impossible task and therefore additional vibration blocking means have been conceived, after the original disclosure, corresponding to my U.S. Pat. No. 3,596,733. The first additional blocking means has been disclosed in my U.S. Pat. No. 3,722,617 consisting in that the side wall continues into an endless channel member 9. Further blocking means, such as endless channel member 16 are already fully disclosed in my U.S. Pat. No. 4,003,449.

The marginal portion 4 of the diaphragm 1 is of less thickness than the asymmetrically shaped portion 5 defining the central portion of the diaphragm 1 and is spaced apart therefrom through an endless channel 11. The channel 11 has a bottom portion and two side portions of unequal height, the one of lesser height being the one ending into the marginal portion of the diaphragm 1. Thus the thickness between said bottom portion of the channel 11 and the front face 2 is reduced to a minimum and is less than that of the marginal portion 4. The endless channel 11 defines a pivotal connection between the marginal portion 4 and the central portion including the asymmetrically shaped portion 5.

Between the asymmetrically shaped portion 5 and the endless channel 11 a number of further channels are provided, which are shown in FIG. 1, but which will not be described in detail, inasmuch as they do not form part of the present invention and have been fully described in my above referred to earlier U.S. Pat. No. 4,003,449. It being sufficient to indicate that corner portions 12, 13, 14, 15 are formed which may be used, such as shown for the corner portion 14, to connect thereto a tweeter 10.

The principle of operation of the diaphragm has already been described in my above referred to U.S. Pat. No. 3,596,733 and bearing in mind the teaching thereof it will be understood, that upon connecting the voice coil (not shown) to the central recess 6, that the asymmetrically shaped portion 5 is the one to vibrate and although the endless channel members 9 and 16, as well as the channel 11, tend to reduce the transmission of vibrations into the marginal portion 4, this cannot be totally avoided. Thus there is a tendency that part of the vibrations are transmitted to the aluminium frame 17 which, being of another material has a different behaviour, whereby a certain amount of parasite vibrations are retransmitted to the diaphragm. In my aforementioned U.S. Pat. No. 4,003,449 I have already proposed to link the frame 17 to the marginal portion through a damping washer. Test have now shown, that if the marginal portion 4 has a particular shape, so as to provide smaller and spaced apart contact surfaces with the frame 17, that then the amount of vibratory reflections from the aluminium frame 17 towards the diaphragm is smaller, and thereby a better sound effect is achieved. To this end the marginal portion 4 defines a plurality of spaced apart teeth-like projections 18, whereby each teeth-like projection is spaced from its adjacent one by a "C" shaped recess, the bottom portion of which is adjacent and parallel to the endless channel 11, as clearly shown in FIG. 3, or as shown in the alternative embodiment of FIG. 5, the bottom portion 19" actually defines one side wall in the pertinent portion of the channel 11.

Furthermore, the channel 11 acts as a hinge in combination with the teeth-like projections 18. The upper faces of said teeth-like projections are adhesively connected to a resilient cushion-like damping washer 20. The washer 20 is specifically shown in FIG. 6 as defining a central line 21 and being of rectangular cross-section. The washer 20 has two parallel faces 22 and 23, each having an adhesive layer as shown in FIG. 4 in connection with face 22. The face 22 is linked to the teeth-like projection and the face 23, to the frame 17.

Furthermore, the washer 20 has blind cuts 24, the bottoms of which are adjacent the face 23 and they open into the face 22. These cuts 24 are oriented at right angle or perpendicular to said central line 21. The cuts 24 are spaced apart, one from another, in such a distance, so as to become conveniently arranged within the space defined by each "C" shaped portion, as shown in FIG. 4.

Upon the asymmetrically shaped portion 5 starting to vibrate in any particular section or the pertinent corner 14 of the tweeter 10, the teeth-like projections 18 in combination with the channel 11 provide for the vibrating portion an almost lineal movement, due to the operating channel 11 and without reflecting any substantial amount of parasite vibrations from the frame 17 due to the fact, that the connection therewith is not a continuous connection but an intermittent one, in view of the teeth-like projections 18.

The reason for providing the blind cuts 24 is that the amount of heat which is transferred from the voice coil to the "U" shaped aluminium frame 17 and stored therein is different from the one transferred and stored by the diaphragm, and therefore these slots or cuts 24 compensate on the one hand any differences in expansion and contraction of the two materials in operation, and on the other hand cooperate in absorbing parasite vibrations since the washer sections between adjacent cuts act as individual dampers.

It will be understood, that improvements may be introduced in the embodiments described by way of example and modifications may be made in the construction and material employed, without departing from the scope of the invention.

I claim:

1. A substantially planar diaphragm and supporting frame assembly, preferably for loudspeakers, where on the rear face side of said diaphragm there is an asymmetrically shaped sound producing portion defining the central portion of said diaphragm, which central portion is surrounded by a marginal portion including spaced-apart teeth-like projections which define the periphery of said marginal portion and an endless channel in said marginal portion betwen said teeth-like projections and said central portion, a resilient cushion-like damping washer having two opposite faces one face of which is linked to said teeth-like projections and the other face being linked to said supporting frame.

2. The substantially planar diaphragm and supporting frame assembly of claim 1, wherein said washer has blind cuts on said one face, at least in those portions which are located in-between said spaced-apart teeth-like projections.

3. The substantially planar diaphragm and supporting frame assembly of claim 1, wherein each blind cut has a bottom portion adjacent said other face and said blind cuts are perpendicularly aligned to the center line of said washer, which is of rectangular cross-section.

4. The substantially planar diaphragm and supporting frame assembly of claim 1, wherein said marginal portion defines between each pair of adjacent teeth-like projections a "C" shaped recess, the bottom of which is spaced apart from said endless channel.

5. The substantially planar diaphragm and supporting frame assembly of claim 1, wherein said marginal portion defines between each pair of adjacent teeth-like projections a "C" shaped recess, the bottom of which is adjacent to said endless channel.

6. The substantially planar diaphragm and supporting frame assembly of claim 1, wherein said endless channel has a bottom portion and two side portions of unequal height, the one of lesser height being adjacent to said teeth-like projections.

* * * * *